United States Patent [19]

Capelle

[11] 4,110,283

[45] Aug. 29, 1978

[54] CRYSTALLIZATION INHIBITOR FOR PARAFFIN

[75] Inventor: Anthony Capelle, Stad-Delden, Netherlands

[73] Assignee: Chemische Fabriek Servo B.V., Delden, Netherlands

[21] Appl. No.: 795,633

[22] Filed: May 10, 1977

[51] Int. Cl.[2] ..... C09K 3/00

[52] U.S. Cl. ..... 260/23 AR; 252/8.3; 252/8.55 B

[58] Field of Search ..... 260/23 AR, 23 EM; 252/8.3, 8.55 B

[56] References Cited

U.S. PATENT DOCUMENTS

| | | | |
|---|---|---|---|
| 2,839,512 | 6/1958 | Barnum et al. | 252/8.3 |
| 3,722,592 | 3/1973 | Bucaram et al. | 252/8.3 |
| 3,957,659 | 5/1976 | van de Kraats et al. | 252/8.3 |
| 4,045,360 | 8/1977 | Fischer et al. | 252/8.3 |

FOREIGN PATENT DOCUMENTS

| | | | |
|---|---|---|---|
| 608,195 | 11/1960 | Canada | 252/8.3 |
| 631,796 | 11/1961 | Canada | 252/8.3 |

*Primary Examiner*—V.P. Hoke

*Attorney, Agent, or Firm*—Browdy and Neimark

[57] ABSTRACT

The invention refers to crystallization inhibitor compositions, which contain as the active component a copolymer of 4-vinyl pyridine and of acrylic acid esters, dispersed in an aqueous medium. They are suitable for use in paraffinic oils to prevent the deposition of solid paraffin on walls of containers and pipelines.

While the known compositions which contain the same active component are not suitable for use under field conditions due to their high solidification temperature, the novel compositions can be used at temperatures as low as −15° C. and the dispersions are quite stable on storage and have low viscosity.

8 Claims, No Drawings

CRYSTALLIZATION INHIBITOR FOR PARAFFIN

FIELD OF THE INVENTION

The invention relates to a crystallization inhibitor for paraffin, which contains as the active component a copolymer of 4-vinyl pyridine with esters of acrylic acid and of alcohols having at least 10 carbon atoms.

BACKGROUND OF THE INVENTION

An inhibitor of this type is known from South African Pat. No. 721,862, which discloses such a copolymer and a process for preparing same, and which also proposes to dissolve this copolymer in petroleum to prevent crystallization of paraffin. According to said patent there is preferably used a copolymer of 4-vinyl pyridine with an acrylate of a saturated, straight-chained alcohol having at least 14 carbon atoms, in particular 18–20 carbon atoms, or a mixture of such alcohols. The molecular weight of the copolymer is preferably not higher than 100,000; and a molecular weight of about 40,000, in an amount of up to 2 wt.%, preferably 0.002–0.2 wt.%, has appeared to be highly suitable.

The molar ratio of vinyl pyridine and acrylate ester in the polymer chain may vary between 5:1 and 1:20, and preferably ranges between 1:1, and 1:10. According to said patent, the copolymer may suitably be added to the oil in the form of a solution in a hydrocarbon, such as toluene.

When an oil contains paraffin, this crystallizes out on cooling and in many cases there is formed a three-dimensional network of scales and/or fine needles, which is filled with oil. Such a structure does not flow or hardly so and it is very difficult to pump, while in pipe lines and in storage tanks or in ship tanks mostly considerable amounts of oil remain behind between the paraffin crystallized onto the walls.

When, however, the above-mentioned copolymer is added to the oil in still hot condition, i.e. when the paraffin is still in solution, the crystallization of the paraffin proceeds differently, namely with formation of more massive crystals, so that the temperature at which the oil no longer flows is lowered considerably and, therefore, the above problems occur to a far less extent.

As long as a paraffin containing crude oil is present in an oil containing layer, it usually has an elevated temperature which varies according to the depth, but usually the paraffin is then still fluid. When this oil is pumped up through a borehole, it passes the layers thereabove, the temperature of which becomes gradually lower, so that also during pumping up the oil is cooled and paraffin may crystallize onto the walls of the pump tube or of the above-ground pipes as soon as the saturation temperature is transgressed. The crystals so formed gradually decrease the free diameter of the tube, and the recovery of oil from such boreholes is difficult in such cases, because the pump tube has to be cleaned periodically, for example, by pumping through hot water or by introducing a scraper therein.

In the said South African patent it is therefore proposed to pump the above copolymer in the form of a solution in e.g. toluene through a narrow tube to the bottom of the borehole, where this solution is then mixed with the petroleum and impedes the crystallization of the paraffin, so that during pumping up the viscosity increases to a far less extent.

However, with such methods there occur considerable difficulties.

The copolymer itself is a solid substance at all the temperatures to be considered, while a solution in e.g. toluene at a concentration of e.g. 40% is also solid at 20° C. and therefore has to be heated to about 40° C. before it can be added to the oil.

Of course, this addition is effected most favorably when all the paraffin is still in solution, that is at an elevated temperature, but it is inconvenient when also the inhibitor to be added has to be heated prior to being added.

These drawbacks are particularly troublesome when the inhibitor has to be added in the oil recovery field, either at the bottom of the borehole or in a pump line, and over long periods, e.g. some weeks or months. For in the oil recovery field it is very troublesome in practice to keep the dosing apparatus continuously at a sufficiently high temperature to prevent solidification of the composition and hence blocking of the supply line with certainty. Yet this is necessary in most cases, since the dosing apparatus has to work completely automatically and without supervision for a long time and preferably should be as simple as possible.

It appeared not to be possible to avoid this high solidification point of the solution in toluene by using another oil-miscible solvent, because also in that case the solution appears to have a solidification point or saturation point well above room temperature, while from a technical viewpoint it is desirable that the dosing can normally be continued, even at ambient temperatues as low as −15° C. The use of a more diluted solution is not suitable either, since in that case extremely diluted solutions (e.g. 1% or less) would have to be used, which on the one hand increases the cost and on the other hand would require a large-sized container for the solution. Since such diluted solutions are not suitable to be stored, it would furthermore be necessary to prepare same on the spot, which means an additional complication.

In view of the weather conditions prevailing in oil recovery fields, there is need for a composition which contains the above-mentioned copolymers in a not too low concentration (e.g. at least 7–8 wt.%), in the entire temperature range of from −15° C. to +50° C. is fluid and stable, and has a viscosity of at most 100 cP at 20° C. and at most 300 cP at 5° C.

SUMMARY OF THE INVENTION

Now, it has been found that all these requirements can be complied with simultaneously by an emulsion of the copolymer in an aqueous medium, which also contains emulsifiers.

Therefore, according to the invention the crystallization inhibitor for paraffin consists of an aqueous emulsion containing (a) the above-mentioned copolymer or a solution thereof in a hydrocarbon, e.g. 1 40% solution in toluene;

(b) a mixture of water with an organic solvent, which mixture has a freezing point of at most −15° C;

(c) as emulsifier a mixture of (1) an ethoxylated fatty acid having 10–24 carbon atoms in the fatty acid radical and 4–22, preferably 9–13, ethoxy groups, in particular stearic acid having 10 ethoxyl groups, and (2) an alkylol amide ($—CH_2—CH_2—O—$) obtained by condensing a fatty acid having 10–24 carbon atoms, preferably coconut fatty acids, with 1–2 moles, preferably 1 mole, of a dialkylol amine having 2–4 carbon atoms per alkylol group, in particular with diethanol amine; and (d) as neutralizing agent fatty acids from tall oil.

Of the components *b–d* none can be dispensed with, because otherwise at least one of the requirements set cannot be complied with.

Since an emulsion breaks when the aqueous medium freezes, it is necessary that the freezing point of said medium is sufficiently low. This can be achieved in a simple manner by adding to the water a sufficiently large amount of an organic solvent, such as methanol, ethanol, diethylene glycol, but preferably ethylene glycol. It is not possible to lower the freezing point by dissolving a salt in the water, because on addition of salts the emulsion will break.

Some of the emulsifiers examined appeared to be capable of more or less properly emulsifying the copolymer, but none of the examined emulsifiers separately appeared to lead to an emulsion which even after a long storage time, e.g. after some months, is also stable in the entire temperature range, while it appeared not to be possible, once an emulsion is broken, to re-emulsify the copolymer by simply shaking or stirring. Therefore, such emulsions are insufficiently reliable for the object in view.

In particular, when as the emuslifier there is used only the ethoxylated fatty acid mentioned under (c), there is obtained an emulsion, but it is unsatisfactory because it is not stable. When only the alkylol amide mentioned under (c) is used, there is obtained an emulsion which at room temperature is stable for some time, but at a low temperature it cannot be used because the solidification point is too high, so that such an emulsion cannot be used in freezing weather. Furthermore it appears that this emulsion is not resistant to being stored for several weeks.

When the emulsifiers mentioned under (c) are used together, without component (d), then the emulsion is not stable upon storage either because after some time the solution coagulates.

The copolymer used reacts alkaline as a result of the pyridine groups present therein, and the two emulsifier components also react alkaline.

According to the invention, the emulsion furthermore contains a sufficient amount of tall oil fatty acids to neutralize the mixture. These tall oil fatty acids contain 60% oleic acid and in addition saturated fatty acids, such as palmitic acid, and poly-unsaturated fatty acids. It is striking that oleic acid in itself as a neutralizing agent does not lead to a satisfactory stability upon storage. However, the tall oil fatty acids do have this effect, and then a properly stable emulsion can be obtained.

In addition to the components mentioned, the emulsion may contain still other non-essential components, provided they do not adversely affect the stability of the emulsion. For example, there may be added dyes or still other organic solvents or other additives desirable for the oil in question.

In order to prepare the emulsions according to the invention, first components (a), (c) and (d) are mixed and heated until they are thinly fluid, e.g. to 40°–60° C. and in particular to 50° C., and then component (b) is added under vigorous stirring. Preferably, this addition is carried out gradually and very slowly, e.g. in the course of some hours under continuous stirring.

In this manner it is possible to prepare a reliable emulsion, which contains e.g. 10 wt.% of the copolymer and which can be pumped without difficulty at all temperatures between −15° C. and +50° C. and at these temperatures is stable for several months.

DESCRIPTION OF THE PREFERRED EMBODIMENTS

According to a preferred embodiment of the invention, the emulsion contains (a) 20–30 parts by weight of an e.g. 40% solution of the copolymer in toluene;

(b) 2–4 parts by weight of ethoxylated stearic acid having 10 ethoxyl groups per molecule;

(c) 2–4 parts by weight of coconut fatty acid diethanol amide;

(d) 3–5 parts by weight of tall oil fatty acids; and (e) a mixture of 40–45 parts by weight of water and 20–25 parts by weight of ethylene glycol.

The emulsion according to the invention is of the oil-in-water type and it is surprising that such an emulsion is yet suitable to be added to a petroleum or petroleum fraction as crystallization inhibitor, since it was to be expected that the emulsified copolymer would not or only slowly be taken up in the oil. It was found, however, that the copolymer is quickly precipitated from the emulsion and taken up in the oil, when in addition to the oil there is also present salt or brine, which in practice is always the case when oil is pumped up from a borehole. This salt precipitates the copolymer from the emulsion, so that it can dissolve in the oil.

Therefore, the emulsion can be added to the oil by simply pumping same downwardy in the desired amount through a narrow tube into the borehole to a depth where the oil is still warm enough to keep all the paraffin in solution. When this depth is not exactly known, it is of course possible to simply pump the emulsion downwardly to the bottom of the borehole. When the crystallization of the paraffin does not start until after the oil has come to the surface, it is also possible to add the emulsion above-ground at a suitable point.

Always the emulsion should be added to the oil at a stage wherein none or hardly any solid paraffin is crystallized out, because the copolymer has no influence on already crystallized paraffin.

EXAMPLE

In a laboratory mixer were brought together:

25 parts by weight of a 40% solution in toluene of a copolymer of 4-vinyl pyridine and alkyl acrylate having an average of 21 carbon atoms in the alkyl groups (molar ratio of 4-vinyl pyridine to acrylate: 0.3:1), and a molecular weight of about 40,000;

3 parts by weight of ethoxylated stearic acid having 10 ethoxyl groups per molecule;

3 parts by weight of coconut fatty acid diethanol amide; and 4 parts by weight of tall oil fatty acid.

These components were heated to 50° C. and properly mixed to form a thinly fluid mass.

Then there was added under continuous and vigorous stirring in the course of 3 hours a mixture of 42 parts by weight of water and 21 parts by weight of ethylene glycol and, after all had been added, the mixture was stirred for 2 hours more. During this period the emulsion formed was cooled to room temperature.

This emulsion appeared to be very stable, even after storage for 3 months. The solidification point of the emulsion was −15° C., while cooling to a slightly higher temperature caused no coagulation. The viscosity at 20° C. was 80 cP, while the 40% solution in toluene used as the starting material is solid at 20° C.

The emulsion so prepared was used in an oil well which produced oil, from which paraffin crystallized out upon cooling.

Previously there had been won from this well oil without use being made of any additive. This oil had a solidification point of +12° C. In this connection it appeared that paraffin crystalls were deposited on the walls of the pump tube under the ground, as a result of which the free diameter gradually decreased and the required pumping power increased, so that it was necessary each time after about 7 to 8 weeks to clean the pump tube by rinsing same with hot water to melt the paraffin.

Laboratary tests showed that with 600 parts by weight of a 10% solution of the copolymer in a mixture of toluene and benzine on million parts by weight of oil the solidification point was lowered to −15° C., with 500 ppm to +3° C., and with 320 ppm to +6° C.

The addition was started at a moment when, after the last cleaning, oil had been pumped from the well for 6 weeks already, so that it was to be expected that the following cleaning would be necessary after 2 further weeks.

Initially there was added a 10% solution of the copolymer in a mixture of toluene and benzine, which is solid at toom temperature. The solution was melted and pumped through a narrow tube to into the bottom of the well, where the solution was mixed with the oil. The dose used was a 440 ppm copolymer solution.

From dynamometer measurements before and during the addition it appeared that the resistance of the pump tube remained practically constant, so that apparently the deposition of paraffin had stopped.

However, it was not possible to keep the dosing constant, because already within a few days several blockings occurred owing to the solidification of the copolymer solution in the supply line.

Subsequently, the copolymer solution was replaced by the above-mentioned emulsion at the same dose of copolymer, and the pumping was continued. The well, which earlier had already produced oil for 6 weeks without copolymer additive, could in this way be kept in operation for 22 weeks more before a cleaning was necessary, whereas without addition only a production period of 1–2 weeks was to be expected.

In the addition of the emulsion there occurred no difficulties at all, since the emulsion has no tendency to solidify.

I claim:

1. A crystallization inhibitor for paraffin, which contains as the active component a copolymer of 4-vinyl pyridine with esters of alcohols having at least 10 carbon atoms and acrylic acid in a mole ratio between 5:1 and 1:20 and having a molecular weight not greater than 100,000, wherein the agent consists essentially of an aqueous emulsion containing (a) the copolymer or a solution thereof in a hydrocarbon, said copolymer being present in an amount sufficient to inhibit crystallization of paraffin in petroleum;

(b) a mixture of water with an organic solvent, which mixture has a freezing point of at most −15° C.;

(c) a mixture of (1) an ethoxylated fatty acid emulsifier having 10–24 carbon atoms in the fatty acid radical and 4–22 ethoxyl groups, and (2) an alkylol amide emulsifier obtained by condensing fatty acids having 10–24 carbon atoms with 1–2 moles of a dialkylol amine having 2–4 carbon atoms per alkylol group, said emulsifiers being present in admixture in an amount sufficient to provide an emulsion at freezing to room temperatures; and (d) as neutralizing agent an amount sufficient of fatty acids from tall oil to neutralize the mixture.

2. A crystallization inhibitor according to claim 1, wherein the organic solvent comprises ethylene glycol.

3. A crystallization inhibitor according to claim 2, wherein the water and ethylene glycol are present in a weight ratio of 2:1.

4. A crystallization inhibitor according to claim 1, characterized in that it contains (a) 20–30 parts by weight of a 40% solution of the copolymer in toluene;

(b) 2–4 parts by weight of ethoxylated stearic acid having 10 ethoxyl groups per molecule;

(c) 2–4 parts by weight of coconut fatty acid diethanol amide;

(d) 3–5 parts by weight of tall oil fatty acids;

(e) 40–45 parts by weight of water and (f) 20–25 parts by weight of ethylene glycol.

5. A process for preparing a crystallization inhibitor according to claim 1, characterized by adding the mixture of water and organic solvent slowly and continuously under vigorous stirring to the pre-mixed and heated to 40°–60° C. other components.

6. The application of the crystallization inhibitor of claim 1 in the petroleum recovery by adding the inhibitor to the petroleum inside the borehole.

7. A crystallization inhibitor composition in accordance with claim 1, wherein said ethoxylated fatty acid emulsifier has 9–13 ethoxyl groups; and said alkylol amide emulsifier is obtained by condensing coconut fatty acids with 1 mole of diethanol amine.

8. In a crystallization inhibitor composition for paraffin, containing as the active component a copolymer of 4-vinyl pyridine with esters of alcohols having at least 10 carbon atoms and acrylic acid in a mole ration between 5:1 and 1:20 and having a molecular weight no greater than 100,000, the improvement wherein said composition consists essentially of an aqueous emulsion of (a) said copolymer or a solution thereof in a hydrocarbon, said copolymer being present in an amount of 20–30 parts;

(b) a mixture of 40–45 parts by weight of water with 20–25 parts by weight of an organic solvent, said mixture havig a freezing point of at most −15° C.;

(c) a mixture of (1) 2–4 parts by weight of an ethoxylated fatty acid emulsifier having 10–24 carbon atoms in the fatty acid radical and 9–13 ethoxyl groups, and (2) 2–4 parts by weight of coconut fatty acid diethanol amide; and (d) 3–5 parts by weight of tall oil fatty acids.

* * * * *